United States Patent [19]

Dorsey et al.

[11] 4,038,581

[45] July 26, 1977

[54] CIRCUIT FOR ELIMINATION OF SURFACE CHARGE INTEGRATION

[75] Inventors: Denis Peter Dorsey, Levittown, Pa.; William E. Rodda, Trenton, N.J.

[73] Assignee: RCA Corporation, New York, N.Y.

[21] Appl. No.: 631,326

[22] Filed: Nov. 12, 1975

[51] Int. Cl.[2] ..... H01J 29/52; H01J 29/78

[52] U.S. Cl. ..... 315/13 ST; 315/378; 315/383; 315/386; 340/173 CR

[58] Field of Search ..... 315/383, 386, 13 ST, 315/378; 340/173 CR

[56] References Cited

U.S. PATENT DOCUMENTS

| | | | |
|---|---|---|---|
| 2,501,110 | 3/1950 | Walker | 315/378 |
| 2,768,323 | 10/1956 | Schonover | 315/378 |

OTHER PUBLICATIONS

IEEE Transactions on Electron Devices, vol. Ed-18, No. 4, Apr. 1971, pp. 229-235.

*Primary Examiner*—Maynard R. Wilbur
*Assistant Examiner*—Richard E. Berger
*Attorney, Agent, or Firm*—Edward J. Norton; Carl M. Wright

[57] ABSTRACT

Circuit to apply an offset voltage to be added to a charge storage signal depositing a charge on a radially swept charge storage surface so that the charge storage signal is a minimum at the center of the surface and a maximum at the outer edges of the sweep. This reduces or eliminates the charge integration in the area where the sweep lines converge.

1 Claim, 4 Drawing Figures

CIRCUIT FOR ELIMINATION OF SURFACE CHARGE INTEGRATION

BACKGROUND OF THE INVENTION

Silicon storage tubes can be used to store data such as an entire frame of a television picture or binary computer data. To store a television frame, an electronic beam is passed over the silicon coated surface and the intensity of the beam depositing the charge is varied by the video signal being stored. In an X-Y (rectangular) sweep system, a picture element occupies the same relative position on the silicon screen as it does on the television screen. Binary data can be stored and retrieved using the X and Y instantaneous sweep voltages as addresses.

It has been found that when a silicon storage tube is used to store radially swept (polar) or plan position indicator (PPI) information, the charge on the storage surface near the center where the lines converge becomes integrated. This results in the data around the center of the screen, where the sweep lines converge, being lost or erroneous. This causes a problem when storing the output signal from a PPI radar presentation on such a storage tube. The target information becomes obliterated toward the center because of the integration of charge described above.

The invention described herein is a circuit for radially sweeping a silicon storage tube and recording data thereon so that charge integration is eliminated or reduced in the area where the lines converge.

BRIEF DESCRIPTION OF THE INVENTION

A surface charge storage device records data by a charge deposit in response to the signals to be stored as its surface is radially swept in response to a sweep signal. Control means are provided for varying the charge intensity as a function of the distance of the charge depositer from the center of the surface.

DETAILED DESCRIPTION OF THE INVENTION

Figure 1:
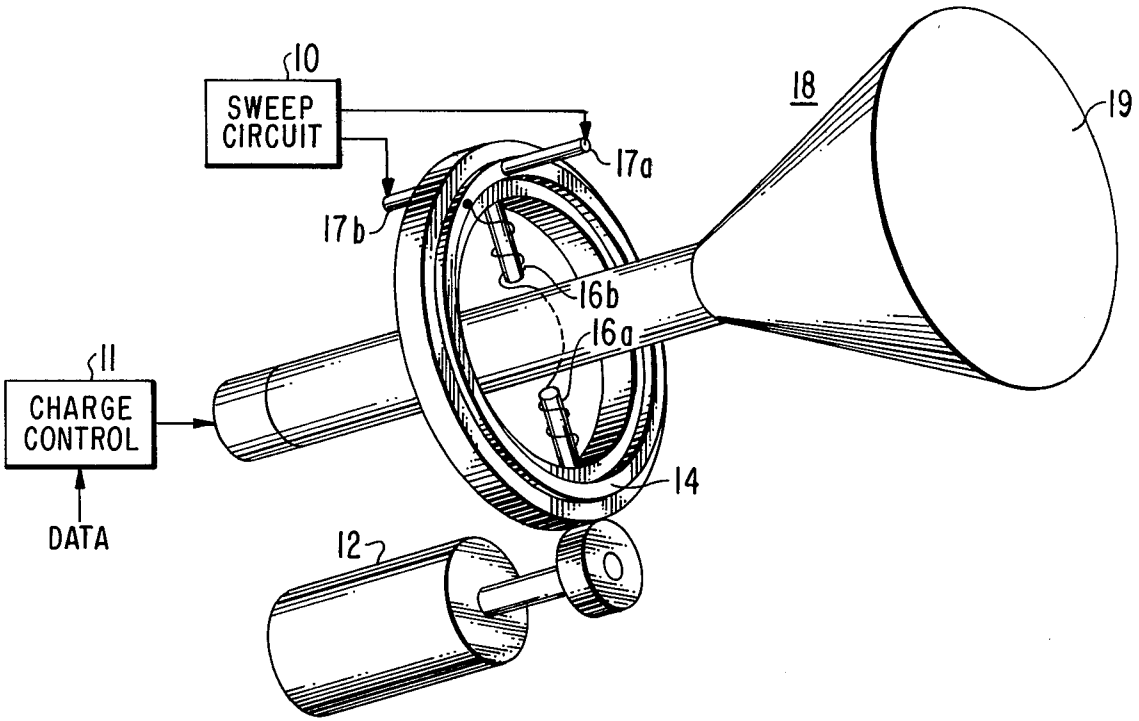
FIG. 1 is a representation of a mechanically rotated radial sweep system for a silicon storage tube.

FIG. 1 is an illustration representation of a silicon storage tube for storing PPI information. A tube 18 has a silicon surface 19 on which the charge is to be deposited. In actual practice, a readout device would overlay the surface 19 for purposes of retrieving the stored information. A yoke comprising windings around two cores 16*a* and 16*b* is coupled to a sweep circuit 10 by suitably mounted brushes 17*a* and 17*b* and through slip rings 14 on each side of the yoke assembly. The sweep circuit 10 produces a sawtooth voltage causing the electron beam generated in the tube to be swept radially from the center of the surface 19 toward the outer edges thereof. The yoke is rotated around the neck of the tube 18 by a motor or servo-motor 12 which can be coupled, for example, to a radar antenna, the presentation of which is to be stored on the surface 19 of the silicon storage tube 18.

Data to be stored controls a charge control circuit 11 which increases or decreases the intensity of the electron beam to vary the charge deposited on the silicon surface 19.

Silicon storage tubes are commercially available which include the recording and the readout devices. For example, see type C22047 (rectangular raster) or type C22054 (square raster) (RCA Corporation). Instead of a rotating yoke as shown in FIG. 1, an X-Y yoke system can be used with special circuits for generating yoke signals which will produce a radial type sweep. For an example of such a circuit, see application Ser. No. 535,816, filed, Dec. 20, 1974, assigned to the same assignee, now abandoned.

Figure 2:
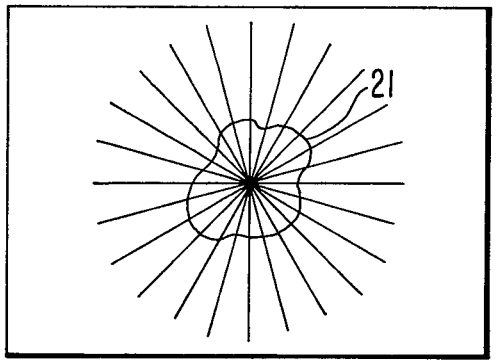
FIG. 2 is a representative graph of the silicon storage surface showing several radial sweep paths.

In FIG. 2, several radial sweep lines are shown. As the lines converge toward the center, the distance therebetween decreases so that a charge deposited by one sweep line begins to overlap and to merge with the charge from an adjacent sweep line. When read out by a rectangular or X-Y sweep, an area 21 around the center may contain completely obliterated data caused by the integration of charges deposited by adjacent sweep lines.

Figure 3:
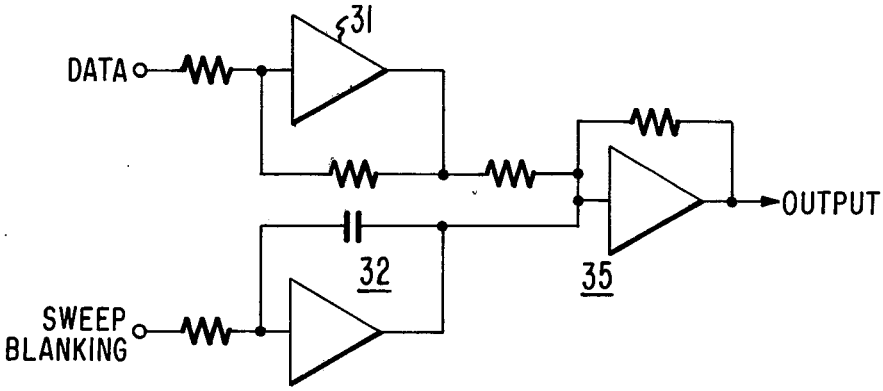
FIG. 3 is a schematic of a preferred embodiment of the circuit according to the invention.

A preferred embodiment of a circuit of the invention is shown in FIG. 3. The data to be stored is applied to an operational amplifier 31 which acts as a buffer and provides signal inversion. Another buffer amplifier can be used for the sweep signal or, as shown in FIG. 3, an integrator 32 can be used to produce a ramp voltage in response to a sweep blanking signal which occurs just before a new sweep line is begun. The data signal from the output of the operational amplifier 31 and the sweep signal output signal from the integrator 32 are combined in an adder 35 to produce an output signal.

Figure 4:
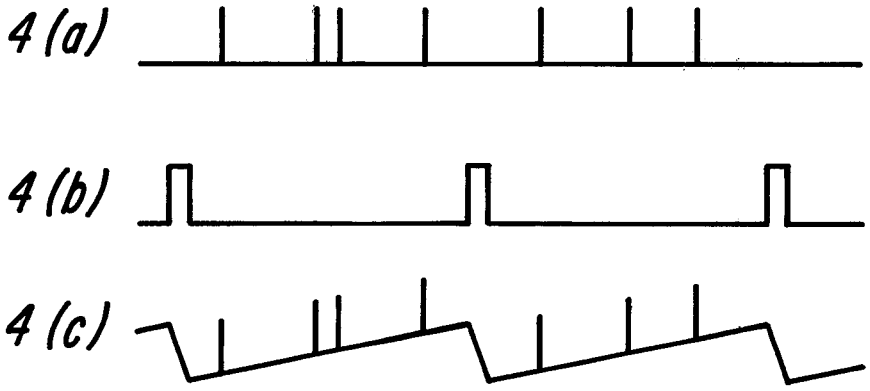
FIG. 4 is a timing graph showing idealized wave forms at various points in the circuit of FIG. 3.

FIG. 4 shows some representative waveforms from the circuit of FIG. 3. For example, FIG. 4(*a*) represents data signals which might represent radar echo returns plotted against time. FIG. 4(*b*) shows the sweep blanking signal which is applied to the integrator 32 of FIG. 3. FIG. 4(*c*) shows the output from the adder 35 where the data signals are superimposed on the sweep output signal from the integrator 32. The blanking pulse is applied for the flyback time, i.e., that time required for the beam to return from the outer edge of the radial sweep line to the center. Therefore, the signal magnitude is a minimum when the sweep is at the center of the surface and increases to a maximum at the outer terminal point of the sweep line. The data recorded at the center of the surface where the radial sweep line converge is thus recorded by a lower charge than that recorded near the outer edge where the sweep lines are spaced farther apart.

The invention therefore produces a signal wherein the charge deposited is inversely proportional to its distance from the center and thus proportional to the spacing between adjacent sweep lines. The smaller charges near the center reduce or prevent charge integration. When reading the recorded information, the inverse of the sweep signal can be used to increase the read amplification near the center to restore the correct relative magnitudes of the retrieved data.

Various modifications to the systems and circuits described and illustrated to explain the concepts and modes of practicing the invention might be made by those of ordinary skill in the art within the principles or scope of the invention as expressed in the appended claims.

What is claimed is:

1. The combination comprising:

surface charge storage means for recording data by charging a surface;

charge deposit means for charging said surface in response to signals to be stored;

sweep means for radially positioning said charge deposit means from the center of the surface in response to a sweep signal; and control means for varying charge intensity as a function of the distance of the charge deposit means from the center of the surface, said control means comprising integrator means responsive to a blanking signal preceding each sweep signal for producing an output signal and adder means responsive to data signals and to said output signal.

* * * * *